US006056707A

United States Patent [19]

Hayashi

[11] Patent Number: 6,056,707

[45] Date of Patent: May 2, 2000

[54] CHAIR-TYPE MASSAGING APPARATUS

[75] Inventor: Noriyuki Hayashi, Osaka, Japan

[73] Assignee: Family Kabushiki Kaisha, Osaka, Japan

[21] Appl. No.: 08/942,028

[22] Filed: Oct. 1, 1997

[30] Foreign Application Priority Data

Jul. 8, 1997 [JP] Japan ..... 9-182807

[51] Int. Cl.[7] ..... A61H 15/00

[52] U.S. Cl. ..... 601/99; 601/100; 601/102; 601/103; 601/111; 601/116

[58] Field of Search ..... 601/98, 49, 51, 601/52, 63, 97, 99, 100, 101, 102, 103, 111, 115, 116, 118, 122, 126, 128, 148, 149, 150, 61, 62; 92/40, 34

[56] References Cited

U.S. PATENT DOCUMENTS 2,643,644 6/1953 Way .
5,092,316 3/1992 Taylor et al. .
5,462,516 10/1995 Anderson .
5,741,218 4/1998 Fujii .

*Primary Examiner*—Danton D. DeMille
*Attorney, Agent, or Firm*—Oblon, Spivak, McClelland, Maier & Neustadt, P.C.

[57] ABSTRACT

An improved chair-type massaging apparatus providing unique massaging effects is provided, which includes a chair body including a seat portion having a substantially horizontally extending seating surface and a backrest portion extending substantially vertically from the seat portion; a first pair of right and left massaging heads disposed inside the backrest portion; a second pair of right and left massaging heads disposed inside the backrest portion and below the first pair of massaging heads; a drive unit for driving each massaging head of the first and second pairs; and a control for controlling the drive unit so as to cause the first and second pairs of massaging heads to perform alternately a first operation such that the left massaging head of the first pair and the right massaging head of the second pair are operated synchronously and a second operation such that the right massaging head of the first pair and the left massaging head of the second pair are operated synchronously.

37 Claims, 11 Drawing Sheets

CHAIR-TYPE MASSAGING APPARATUS

BACKGROUND OF THE INVENTION

The present invention relates to chair-type massaging apparatus.

One conventional chair-type massaging apparatus includes a chair body having a seat portion and a backrest portion, and a massage drive unit 100, as shown in FIG. 11, disposed inside the backrest portion. The massage drive unit 100 is so constructed as to expand and retract massaging heads 103 such as kneading balls with respect to a back portion or a like portion of the user by expanding and contracting air cells 102 each having a bellows periphery 101.

The air cells 102 include upper and lower pairs of right and left air cells disposed on the opposite sides of the backbone position of the backrest portion. By activating the upper pair of air cells 102 and the lower pair of air cells 102 alternately or all the four air cells 102 simultaneously the massage apparatus performs kneading, tapping, vibration and other massaging operations either singly or in combination.

In a massaging apparatus of this type the massage drive unit 100 can be electrically or manually moved substantially along the height of the backrest portion. Among such a massaging apparatus, there are ones which cause massage drive unit 100 to continuously move upward and downward repeatedly in parallel with the aforementioned massaging operations of the massage drive unit 100 thereby providing a rolling massage effect.

Expanding the upper or lower pair of air cells 102 simultaneously causes the corresponding massaging heads 103 to press portions of the user on the right and left sides of the backbone simultaneously. This often makes the user feel repelled from the backrest portion and, hence, cannot provide a satisfactory kneading effect though the resulting tap or vibration massaging effects are satisfactory to a certain extent.

The massage drive unit 100 is constructed to be movable substantially along the height of the backrest portion as described above for each massaging head 103 thereof to move to a position exactly corresponding to a stiff portion of the user's back, thereby providing effective massage. The massage drive unit 100 of such construction is to accommodate itself to different users having different heights and different stiff portions. However, moving the massage drive unit 100 between the neck position and the waist position each time takes too much time and hence may prevent a user from relaxing if the user is impatient.

Further, with the typical massage drive unit employing air cells 102, air discharge from expanded air cells 102 is relatively slow and, hence, the contraction rate of the air cells 102 is relatively low. This, it is difficult for the user to enjoy a feeling of abrupt relief from the pressing of the massaging heads 103. That is, a repetition of kneading or similar motions is too slow, thus resulting in a relatively weaken massaging effects.

To overcome this disadvantage, such massaging apparatus is required to be provided with, for example, a suction device in association with air cells 102. The provision of such suction device or the like, however, makes the apparatus larger in size, more complicated and more costly, and generates more noisy sounds of operations.

The present invention has been accomplished in view of the foregoing circumstances and has an object to provide a chair-type massaging apparatus capable of providing excellent massaging effects by, in particular, kneading operations.

SUMMARY OF THE INVENTION

Accordingly, the present invention provides a massaging apparatus comprising: a chair body including a seat portion having a substantially horizontally extending seating surface and a backrest portion extending substantially vertically from the seat portion; a first pair of right and left massaging heads disposed inside the backrest portion; a second pair of right and left massaging heads disposed inside the backrest portion and below the first pair of massaging heads; a drive unit for driving each massaging head of the first and second pairs; and control means for controlling the drive unit so as to cause the first and second pairs of massaging heads to perform alternately a first operation such that the left massaging head of the first pair and the right massaging head of the second pair are operated synchronously and a second operation such that the right massaging head of the first pair and the left massaging head of the second pair are operated synchronously.

With this construction, a portion of the user situated between the first and second pairs of massaging heads is massaged (kneaded) in a transversely distorted manner. Such massage is herein termed "cross kneading". As a result, a highly effective massaging (kneading) action can be obtained.

The drive unit may comprise air cells corresponding to the first and second pairs of massaging heads. Each air cell is expansible when air is supplied thereinto and contractible when air is discharged therefrom. Each air cell may be provided with air discharge assisting means for producing a biasing force urging the air cell in an expanded condition to contract.

With such a feature, each air cell in an expanded condition contracts rapidly, resulting in a high speed repetition of massaging or kneading operations. Thus, the user can feel abrupt relief from the pressing massaging heads.

The provision of the air discharge assisting means dispenses with a suction device or a like device and hence makes it possible to prevent the massage apparatus from being enlarged in size, becoming more complicated and expensive, and generating noisy operational sounds.

To enhance the massaging effect, it is necessary to properly and accurately stimulate effective spots of a user's body. The inventor of the present invention has discovered the fact that although differences exist between individuals in the position of each effective spot which reflect differences in height between individuals, little difference in the position of each effective spot between individuals sitting in the chair body in terms of coordinates as the height from the hip position is seen in a lower region of the back and in the waist region while greater differences are observed in an upper region of the back including the neck and the shoulders.

Thus, the first and second pairs of massaging heads may be positioned in a lower portion of the backrest portion so as to massage a waist portion of a user sitting in the chair body.

According to the present invention, the massaging apparatus may further comprise a third pair of massaging heads disposed inside the backrest portion and above the first pair of massaging heads, the third pair of massaging heads being movable substantially vertically within the backrest portion. In this case, the first and second pairs of massaging heads may be fixed in the lower portion of the backrest portion.

With this construction, the third pair of massaging heads is not required to move a relatively long distance but a limited distance and, in addition, the first and second pairs of massaging heads can massage the waist of the user in parallel with the operation of the third pair. Thus, the massaging apparatus will scarcely make the user impatient and is capable of providing a press against each effective spot accurately and properly regardless of differences between individuals, for example, in height.

The foregoing and other objects, features and attendant advantages of the present invention will be fully appreciated from the following detailed description when read in connection with the attached drawings.

DETAILED DESCRIPTION OF THE PREFERRED EMBODIMENT

The present invention will now be described in detail with reference to the attached drawings.

Figure 1:
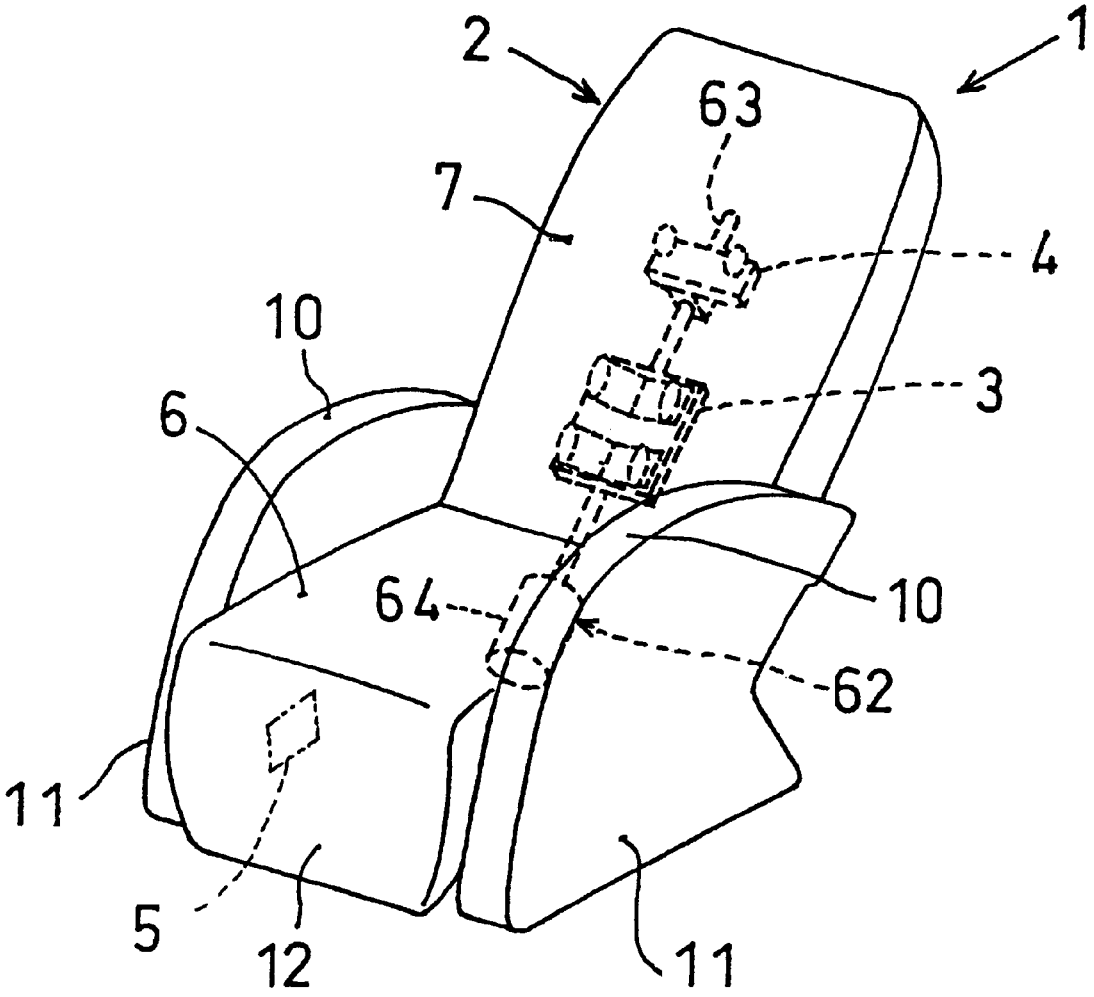
FIG. 1 is a perspective view showing a chair-type massaging apparatus according to the present invention.

Referring first to FIG. 1, chair-type massaging apparatus 1 according to the present invention includes chair body 2, lower massage drive unit 3, upper massage drive unit 4, and control unit 5. The chair body 2 includes seat portion 6 having a substantially horizontally extending seating surface, and backrest portion 7 extending substantially vertically from the seat portion 6. The massage drive units 3 and 4 are both disposed inside the backrest portion 7. The lower massage drive unit 3 is positioned in a lower portion of the backrest portion so as to massage the waist portion of a user sitting in the chair body 2, while the upper massage drive unit 4 is positioned in an upper portion of the backrest portion so as to massage a upper portion of the back of the user including the neck portion and the shoulder portion.

Figure 9:
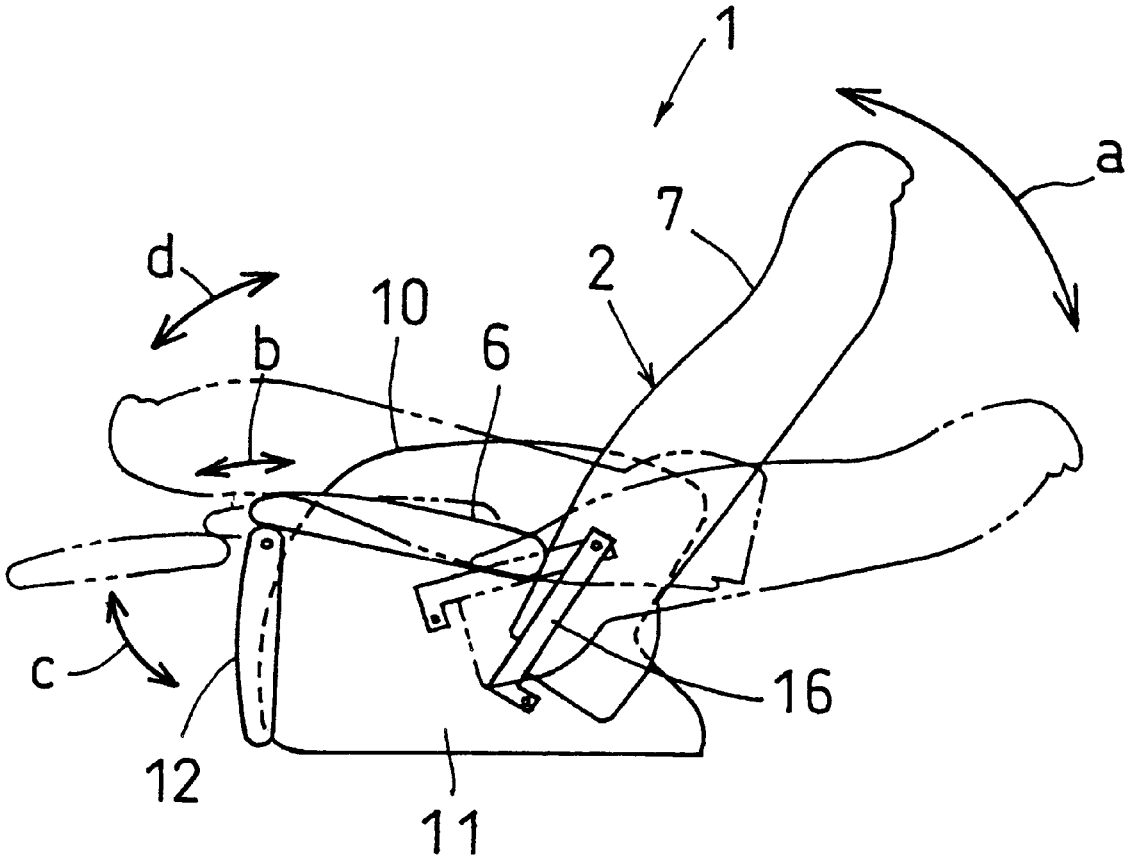
FIG. 9 is a schematic side elevational view of the chair body with the locus of each part thereof moving into the reclining condition and into the folded condition for storage.

The chair body 2 has a pair of leg portions 11 on opposite sides of the seat portion 6 and a footrest 12 situated before the seat portion 6, each leg portion 11 being integrally formed with an armrest portion 10. As shown in FIG. 9, the angular position of each of the backrest portion 7 and footrest 12 relative to the seat portion 6 can be varied for the chair body 2 to be reclinable and collapsible. Thus, the chair-type massaging apparatus 1 can be stored in a compactly folded condition as the case may be.

In reclining the chair body 2, as the backrest portion 7 is laid rearward (see arrow a in FIG. 9), the seat portion 6 moves forward (see arrow b) and the footrest 12 springs up (see arrow c). In returning the chair body 2 into its original position, on the other hand, as the backrest portion 7 is raised up, the seat portion 6 moves rearward and the footrest 12 descends. These movements cooperates with each other through a link mechanism (not shown) and a like mechanism and are automatically or semi-automatically achieved with an appropriate electrical or hydraulic drive mechanism.

In collapsing the chair body 2, the backrest portion 7 is folded forward (see arrow d) with the seat portion 6 in its rear position and the footrest 12 in its lowered position.

Figure 10:
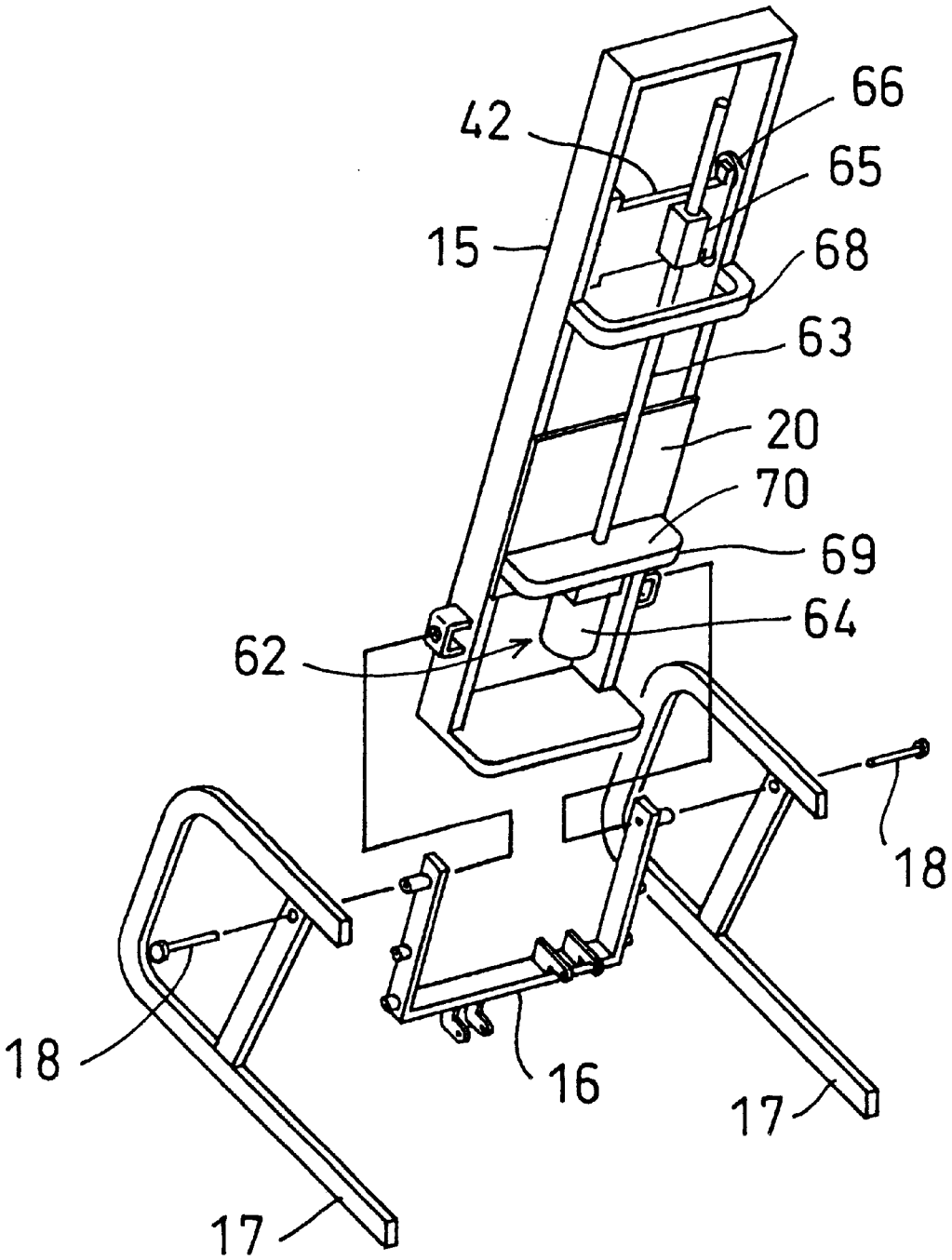
FIG. 10 is an exploded rear perspective view of a back frame supporting structure of the massaging apparatus.
Figure 11:
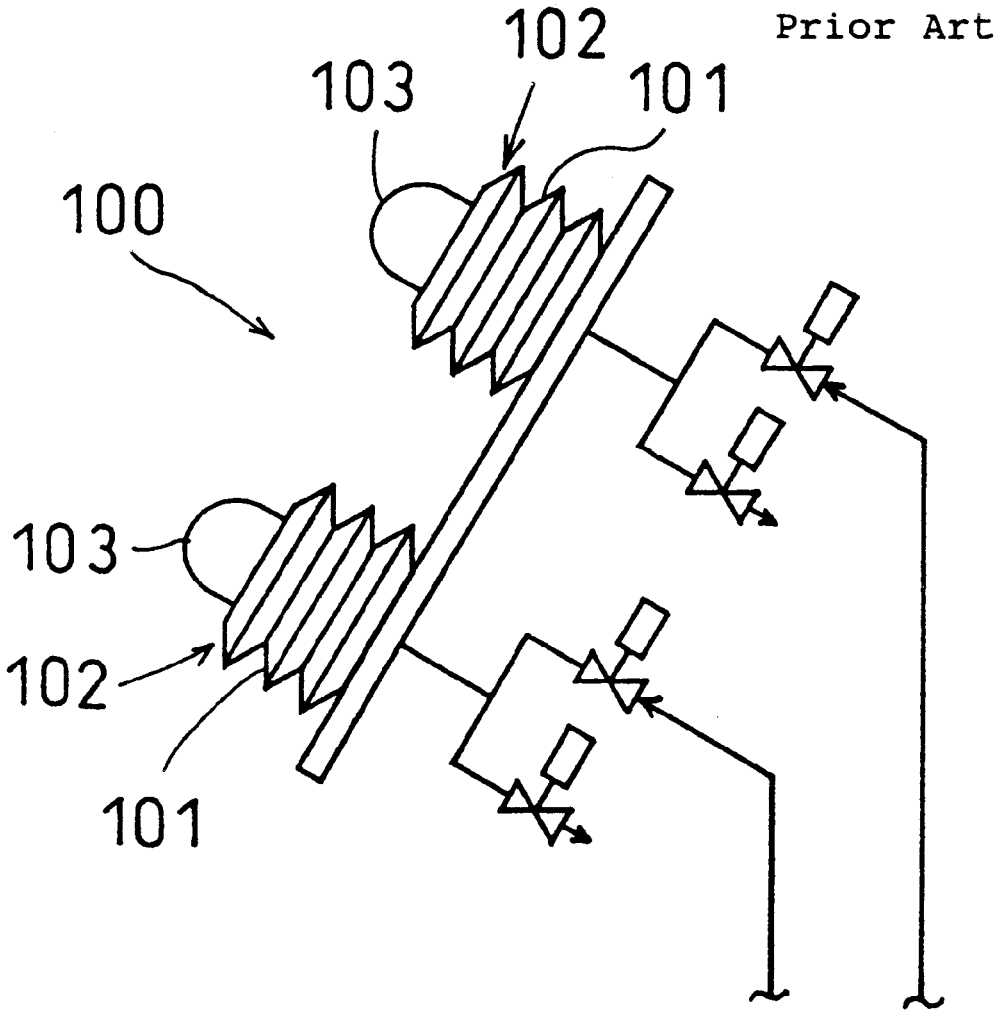
FIG. 11 is a schematic side view of an example of conventional massage drive unit.

Such reclinable and collapsible arrangement is realized by virtue of the provision of a support frame 16 under a back frame 15 forming the backrest portion 7 as shown in FIG. 10. In the reclining movement, the back frame 15 and the support frame 16 rearwardly pivot into the reclined condition as an integral part about pivot shafts 18 respectively extending through leg frames 17. In the collapsing movement, on the other hand, only the back frame 15 forwardly pivots into the folded condition, while the support frame 16 remains stationary relative to the leg frames 17.

Referring to FIGS. 2 to 5, the lower massage drive unit 3 includes a lower base 20 secured to a lower portion of the back frame 15, and upper and lower pairs of right and left air cells 22 secured to the front side of the lower base 20. Each air cell 22 is of a bellows construction adapted to expand when air is supplied thereinto from a pump (not shown) and to contract when air is discharged therefrom. The upper and lower pairs of air cells 22 are provided thereon with first and second pairs of right and left massaging heads 23, respectively.

The first pair of right and left massaging heads 23 are connected to each other through a connection plate 25 having a middle portion serving as a mount portion 24 at which the connection plate 25 is mounted on the lower base 20. The same is true for the second pair of right and left massaging heads 23. The connection plate 25 comprises a plate spring and configured to allow left massaging head 23 to gradually swing about a left edge of the mount portion 24 so as to protrude forwardly rightwardly (in the lower right direction as viewed in FIG. 4) as the corresponding left air cell 22 is expanded and to allow the opposite right massage head 23 to gradually swing about right edge of the mount portion 24 so as to protrude forwardly leftwardly (in the lower left direction as viewed in FIG. 4) as the corresponding right air cell 22 is expanded.

Each massaging head 23 has a substantially vertically elongated semicylindrical bulged portion 26 adapted to press a waist portion of the user. The bulged portions 26 of each pair of massaging heads 23 are symmetrically positioned across a center line of the backrest portion on which the user's backbone will be aligned. Each massaging head 23 is formed of an elastic material such as rubber or soft plastic having a suitable elasticity. Each massaging head 23 may be hollow for enhancing its elasticity or may be solid for utilizing the elasticity of the material itself.

The connection plate 25 comprises a plate spring as stated above and is adapted to assume its normal shape or its unloaded position when the corresponding opposite air cells 22 are in the contracted condition. Thus, the more each air cell is expanded, the more the connection plate 25 accumulates its spring biasing force toward its normal shape. Stated otherwise, the opposite portions of the connection plate 25 on the right and left sides of the mount portion 24 each serve as air discharge assisting member 28 for producing a biasing force facilitating the contraction of the corresponding air cell 22.

Each air cell 22 is fitted at its top with a cylindrical disengagement preventive cap 22*a* having a top surface formed with three engagement projections 22*b* for engaging three engagement holes 25*a* formed in the connection plate 25, thereby fixedly positioning the air cell 22 and connection plate 25 relative to each other.

Each air cell 22 is supported on an inclined support 30 having a slope which increasingly deviates from the base 20 forwardly of the backrest portion 7 (downward in FIG. 4) as it proceeds laterally outwardly of the backrest portion 7. Each air cell 22 is expansible and contractible along a curved expansion/contraction axis following the swinging action of the connection plate 25. The provision of the inclined support 30 makes it possible to minimize the curvature of this expansion/contraction axis.

More specifically, if each air cell 22 is expanded and contracted along a largely curved axis, one portion (laterally outward portion) of the periphery of the air cell 22 would be always largely expanded and contracted, while on the other hand the opposite portion (laterally inward portion) of the periphery would be always less expanded and contracted. Thus, without the inclined support 30, each air cell would be likely to be damaged in its largely expanded/contracted portion or liable to perform irregular expansion/contraction. Such disadvantages can be avoided by the provision of the inclined support 30.

The angle of inclination of the inclined support 30 may be varied depending on the size or the mounting position of the corresponding air cell 22 and a like factor, but is set to about 10° in this embodiment.

The control unit 5 comprises electronic circuitry disposed in a lower portion of the seat portion 6. The lower massage drive unit 3 is controllable by the control unit 5 such that a pair of obliquely opposite air cells 22 (for example, the upper left one and the lower right one respectively corresponding to the left massaging head of the first pair and the right massaging head of the second pair) perform their expansion/contraction operations synchronously and, likewise, the other pair of obliquely opposite air cells 22 (for example, the upper right one and the lower left one respectively corresponding to the right massaging head of the first pair and the left massaging head of the second pair) perform their expansion/contraction operations synchronously, while these pairs of obliquely opposite massaging heads keep an alternate switching timing.

Figure 6:
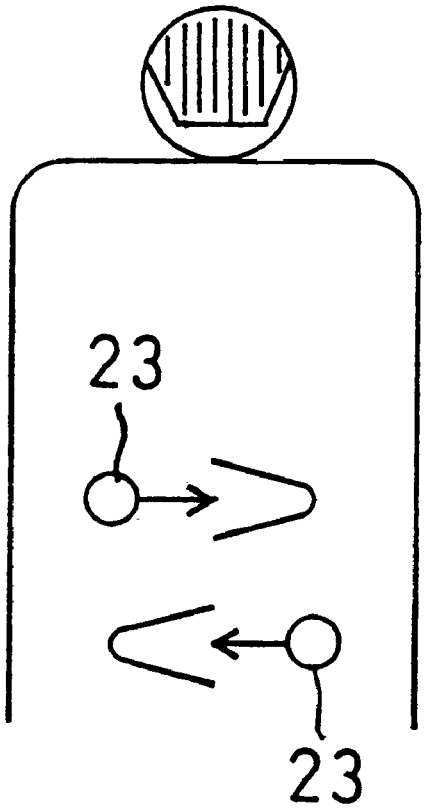
FIGS. 6(*a*) and 6(*b*) are schematic views illustrating the manner of cross massaging the back (waist) of a user by the lower massage drive unit.
Figure 6:
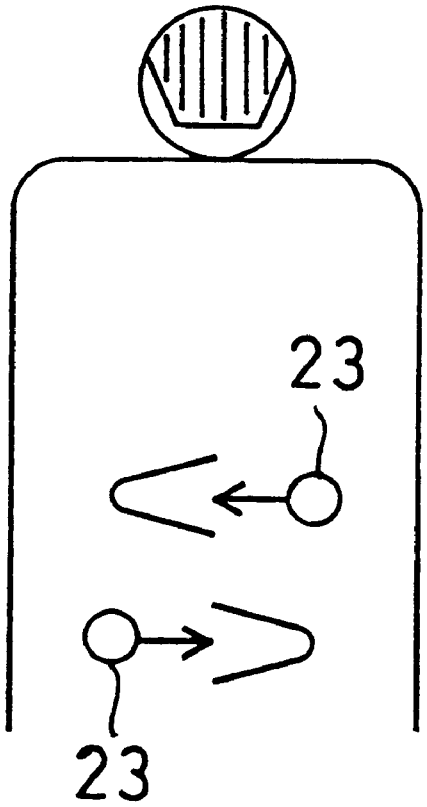

More specifically, the operation of simultaneously pressing upper left and lower right portions of the user's waist as shown in FIG. 6(*a*) repeatedly alternates with the operation of simultaneously pressing upper right and lower left portions of the user's waist as shown in FIG. 6(*b*). Thus, the user receives a strong kneading such as to distort his or her waist transversely. Such a unique massage is herein termed "cross kneading".

The lower drive unit 3 may be controlled such that the upper pair of right and left air cells 22 (corresponding to the first pair of massaging heads) as well as the lower pair of right and left air cells 22 (corresponding to the second pair of massaging heads) are synchronously expanded and contracted to provide a massage effect such as to seize the user's waist. In this case-the upper pair and the lower pair may operate alternately, or all the four air cells 22 may operate synchronously.

Referring to FIGS. 2, 3, 7 and 8, the upper drive unit 4 includes a movable support 42 held in an upper portion of the back frame 15 for substantially vertical movement along guide rails 41 formed in substantially vertically extending opposite frame pieces of the back frame 15, a pair of right and left air cells 43 mounted on the front side of the movable support 42, and a third pair of right and left massaging heads 45 provided on the pair of air cells 43, respectively.

Each massaging head 45 comprises a roller of an elastic material which is rotatable about a substantially horizontally oriented support shaft 46. A bracket member 47 holding this support shaft 46 is pivotally mounted on the movable support 42 through a hinge portion 48 having an axis extending substantially vertically between the right and left air cells 43.

With this arrangement, when the left air cell 43 is expanded, the corresponding massaging head 45 moves toward the right. In contrast, when the right air cell 43 is expanded, the corresponding massaging head 45 moves toward the left.

Figure 8:
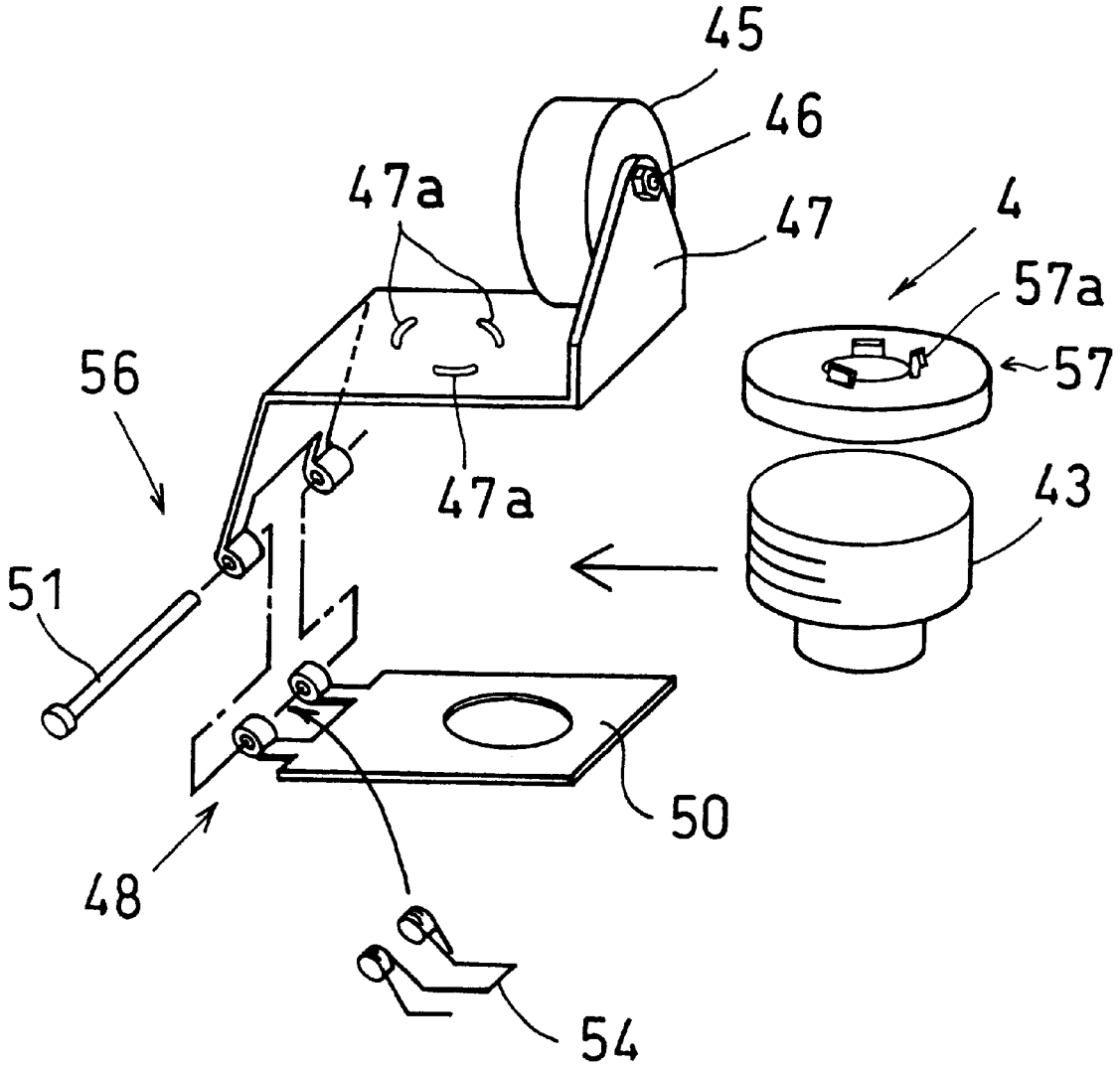
FIG. 8 is an exploded perspective view showing a relevant portion of an upper massage drive unit of the massaging apparatus.

As best seen from FIG. 8, the aforementioned hinge portion 48 has a hinge pin 51 connecting the bracket member 47 and a base plate 50. Each air cell 43 is mounted on the movable support 42 through the base plate 50 which is dimensioned to support the corresponding air cell 43. Thus, each air cell 43 is seen to be held between the corresponding base plate 50 and bracket member 47.

A spring 54 is fitted around the hinge pin 51 so as to urge the bracket member 47 toward the base plate 50. Thus, the spring biasing force to contract each air cell 43 becomes larger as the air cell 43 is increasingly expanded. That is, the portion including the hinge portion 48 and the bracket member 47 serves as an air discharge assisting member 56 for producing such spring biasing force facilitating the contraction of each air cell 43.

Each air cell 43 is fitted at its top with a cylindrical disengagement preventive cap 57 having a top surface formed with three engagement projections 57*a* for engaging three engagement holes 47*a* formed in the bracket member 47 thereby fixedly positioning the air cell 43 and the bracket member 47 relative to each other.

Figure 7:
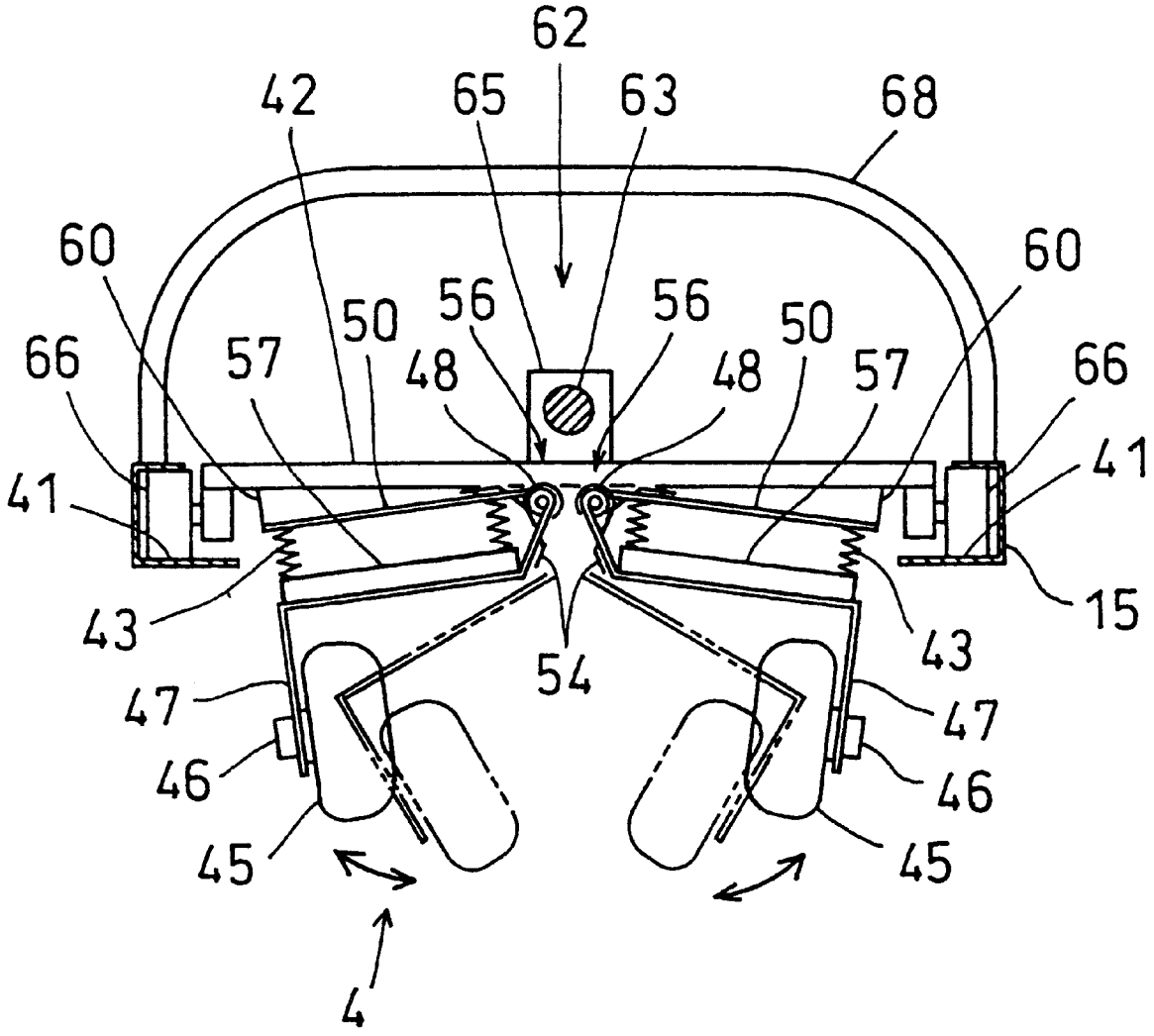
FIG. 7 is an enlarged sectional view taken on line C—C of FIG. 2.

As shown in FIG. 7, each air cell 43 is supported on an inclined support 60 having a slope which increasingly deviates from the movable support 42 forwardly of the backrest portion 7 (downward in FIG. 7) as it proceeds laterally outwardly of the backrest portion 7. Each air cell 43 is expansible and contractible along a curved expansion/contraction axis following the pivoting action of the bracket member 47 and hinge portion 48. The provision of the inclined support 60 makes it possible to minimize the curvature of this expansion/contraction axis.

More specifically, if each air cell 43 is expanded and contracted along a largely curved axis, one side portion (laterally outward portion) of the periphery of the air cell 43 would be always largely expanded and contracted, while on the other hand the opposite portion (laterally inward portion) of the periphery would be always less expanded and contracted. Thus, without the inclined support 60, each air cell 43 would be likely to be damaged in its largely expanded/contracted portion or liable to perform irregular expansion/contraction. Such disadvantages can be avoided by the provision of inclined support 60.

The angle of inclination of the inclined support 60 may be varied depending on the size or the mounting position of the corresponding air cell 43 and a like factor, but is set to about 10° in this embodiment.

The aforementioned movable support 42 is substantially vertically movable along the back frame 15 by means of a movable support drive unit 62. This drive unit 62 comprises a rotatable feed screw shaft 63 extending substantially vertically along the back frame 15 and a power source part 64 including a motor with a decelerator for rotating the feed screw shaft 63 forwardly and reversely. The feed screw shaft 63 threadingly engages and vertically extends through a nut member 65 mounted on the rear side of the movable support 42.

The movable support 42 is provided with an upper pair of opposite guide rollers 66 and a lower pair of opposite guide rollers 66 which allow the movable support 42 to move smoothly along the guide rails 41 formed in the substantially vertically extending opposite frame pieces of the back frame 15.

Figure 2:
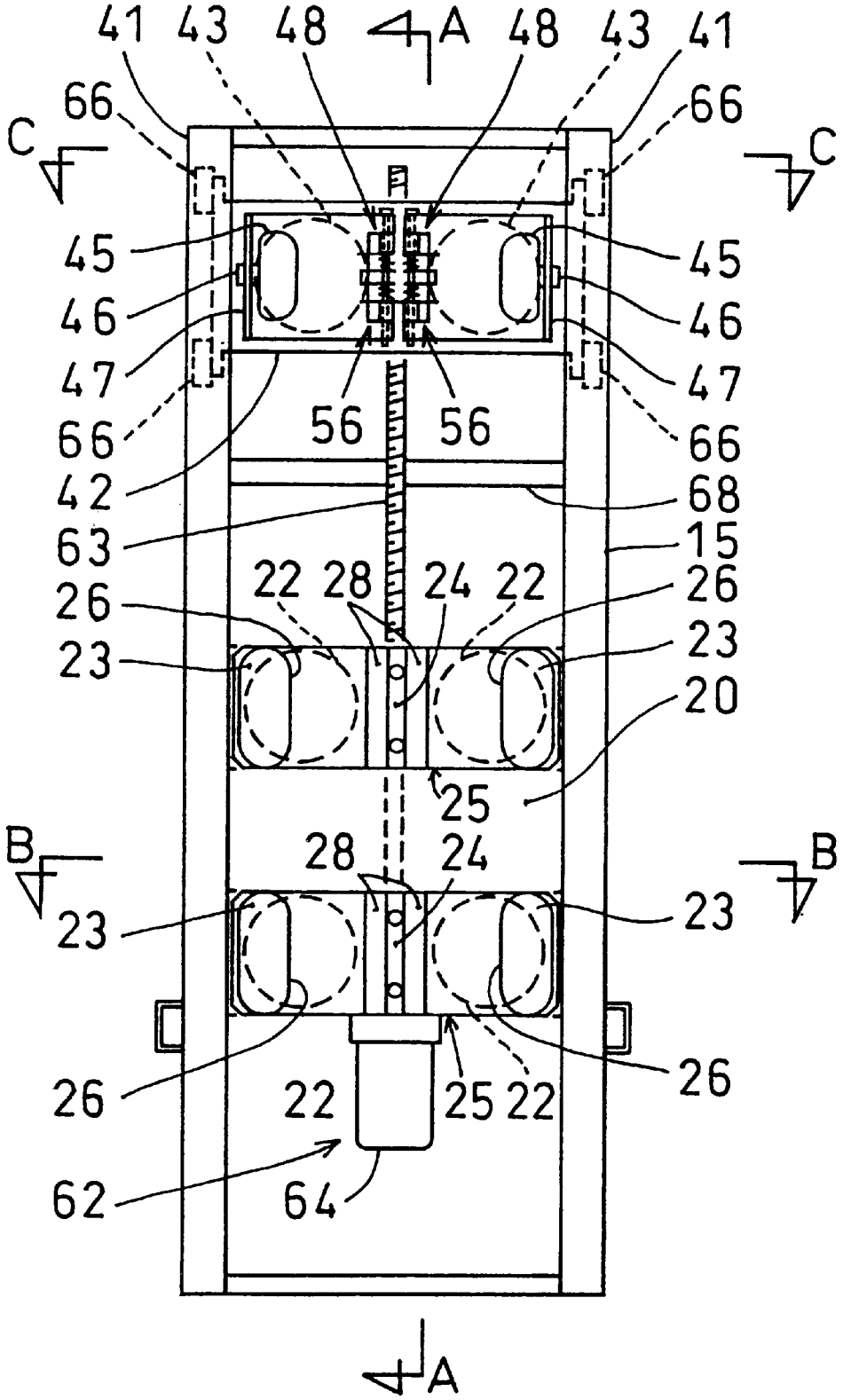
FIG. 2 is a front elevational view of the inside structure (back frame) of a backrest portion of the massaging apparatus shown in FIG. 1.
Figure 3:
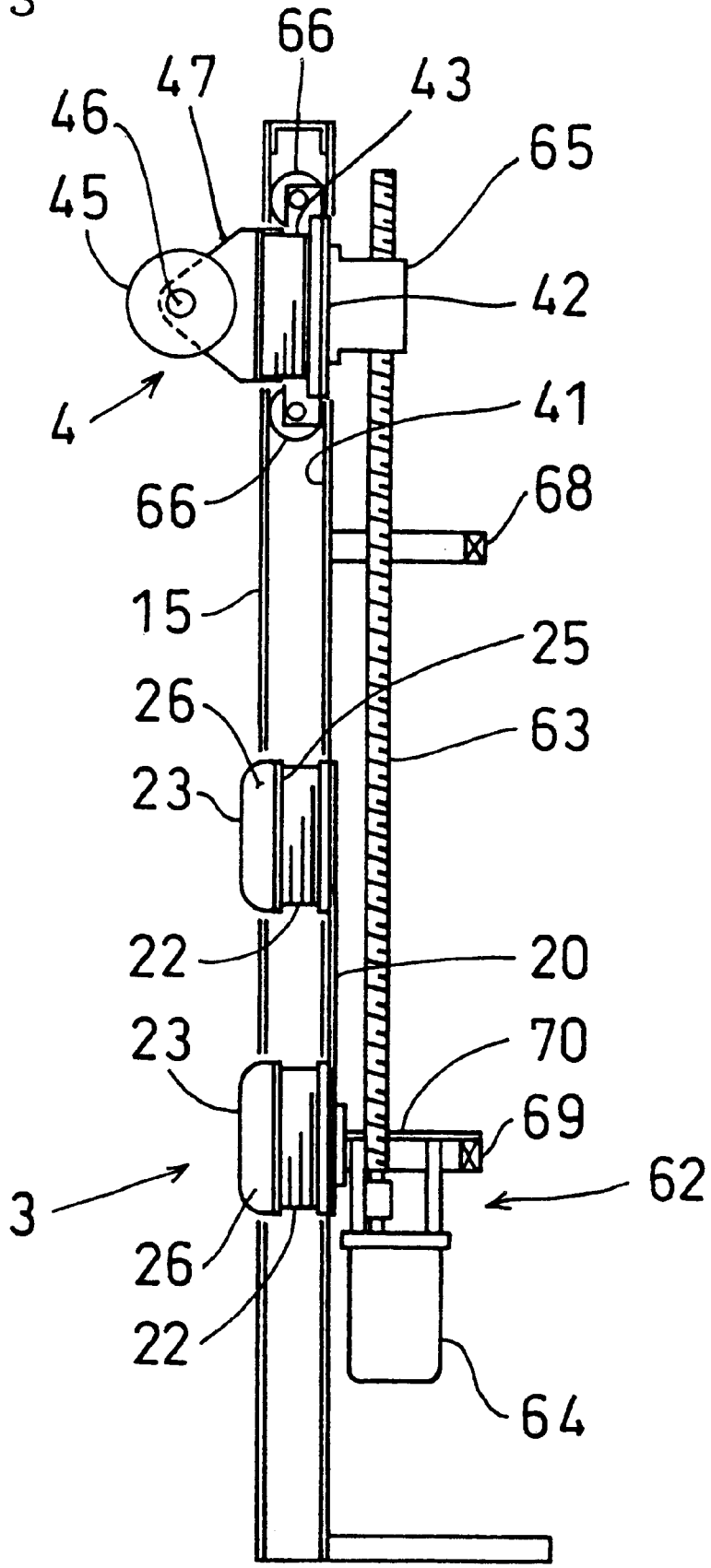
FIG. 3 is a sectional view taken on line A—A of FIG. 2.
Figure 4:
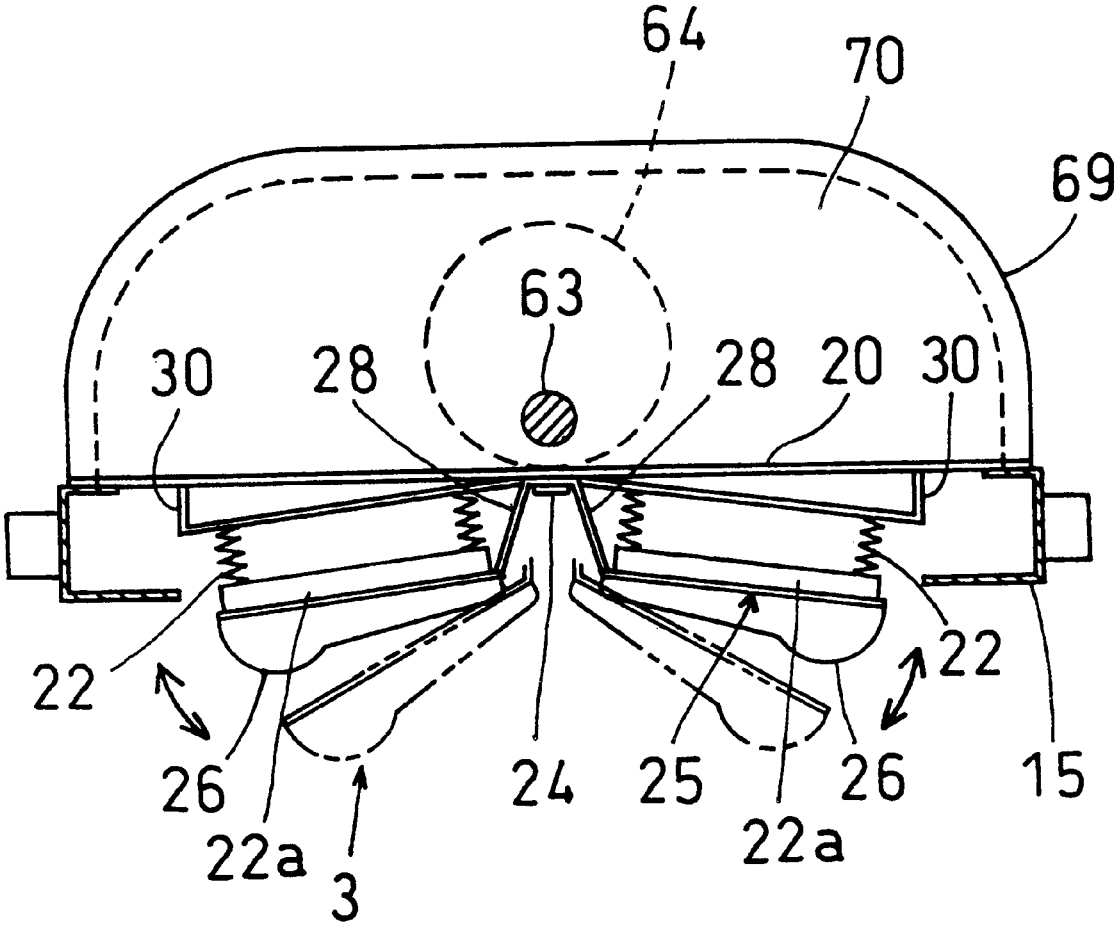
FIG. 4 is an enlarged sectional view taken on line B—B of FIG. 2.
Figure 5:
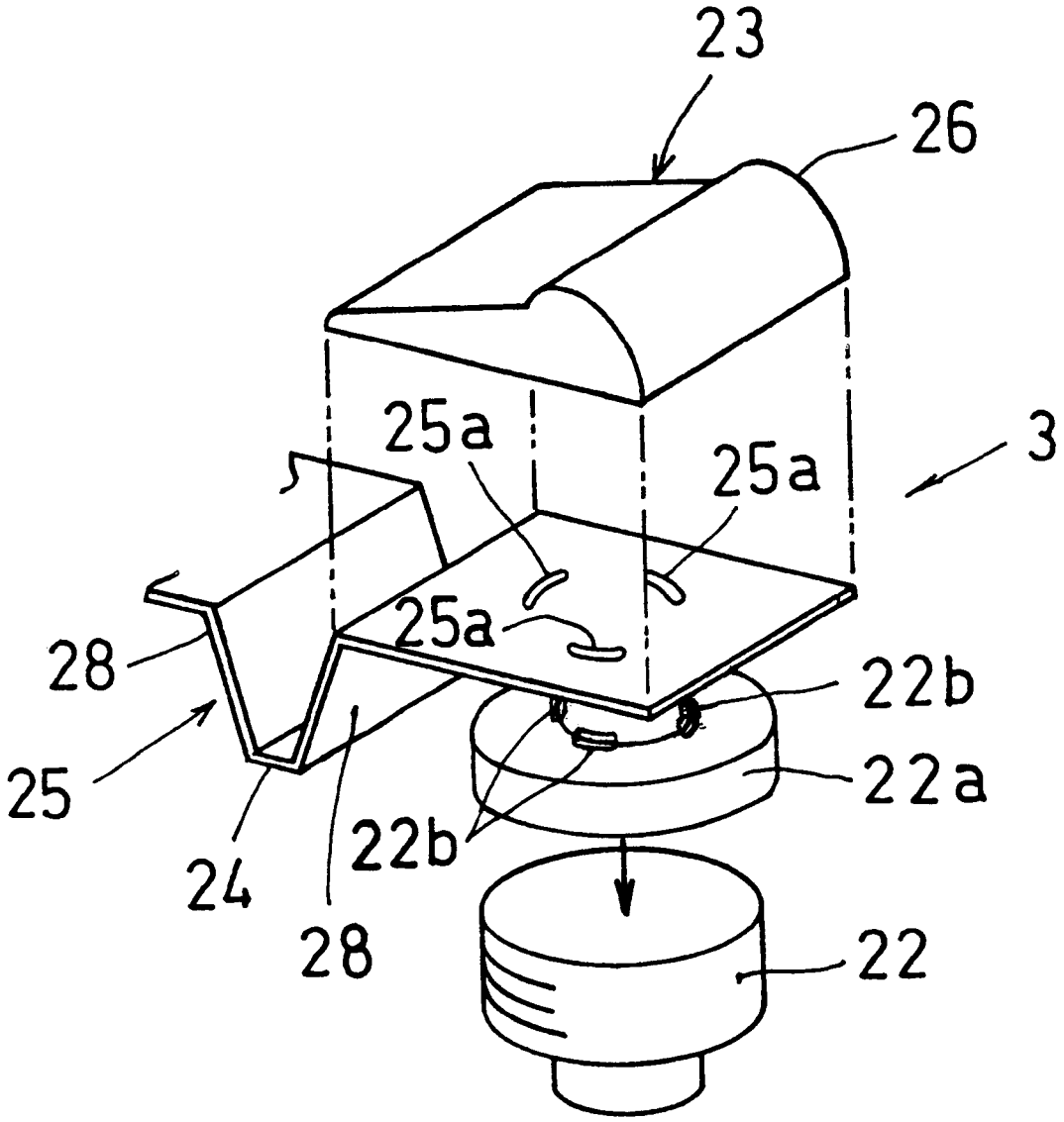
FIG. 5 is an exploded perspective view showing a relevant portion of a lower massage drive unit of the massaging apparatus.

As is clear from FIGS. 2, 3 and 10, the power source part 64 is mounted through a mounting plate 70 to the lower one of upper and lower reinforcing crosspieces 68 and 69 provided on the rear side of the back frame 15, so that the feed screw shaft 63 extends behind the lower massage drive unit 3.

With this arrangement, the movable support 42, or the upper massage drive unit 4 is substantially vertically movable within the largest possible range (i.e., down to the upper edge of the lower massage drive unit 3). However, it is possible to shorten the feed screw shaft 63 by mounting the power source part 64 to the upper reinforcing crosspiece 68 through the mounting plate 70.

In this embodiment, although not shown, a detector for detecting the upper and lower limit positions of the upper massage drive unit 4, such as a limit switch or a sensor, is disposed on the back frame 15 or the movable support 42, thereby allowing for automated traveling of the upper massage drive unit 4.

With the upper massage drive unit 4 thus constructed, opposite sides of the user's backbone and cervical vertebrae from the neck to an upper portion of the back can be massaged simultaneously by causing the right and left air cells 43 to expand and contract synchronously, whereby the user can enjoy a massage effect such as to seize a corresponding portion of the user.

Further, by causing the movable support 42 to reciprocate upward and downward while its air cells 43 are performing their expansion/contraction operation or are halted in their expanded or contracted condition, the user can enjoy a rolling massage effect with the massaging heads 45 rolling on the user's back.

The upper massage drive unit 4 may be operated either alone or simultaneously with the lower massage drive unit 3.

The foregoing embodiment may be modified, for example, as follows.

The lower massage drive unit 3 may also be made upwardly and downwardly movable. On the other hand, the upper massage drive 4 may be made stationary. Where the lower massage drive unit 3 is made upwardly downwardly movable, the movable range thereof may be extended from the waist position to the neck position so as to eliminate the upper massage drive unit 4.

As the upper massage drive unit 4, it is possible to use a massage drive unit of the same construction as the lower massage drive unit 3 by providing such massage drive units of the same construction in the upper and lower portions, respectively, of the back frame 15.

The air discharge assisting members 28,56 respectively associated with the corresponding air cells 22,43 do not necessarily serve also as massaging head supporting members. Thus, it is possible to provide, for example, a coil spring as the air discharge assisting member 28,56 inside or outside each air cell 22,43 for facilitating the contraction of the air cell.

Further, the inclined supports 30,60 supporting the air cells 22,43 may be eliminated. Each air cell 22,43 may be shaped square in plan instead of the circular shape. Each massaging head 23,45 is not particularly limited in shape or in supporting structure.

Each air cell 22,43 may be of a balloon construction instead of the bellows construction or may be constructed to directly press a user's body without using the corresponding massaging head 22,45.

The chair body 2 is not limited in its particular structures. For example, the seat portion 6 or the footrest 12 may be provided with an appropriate massage drive unit.

While only a presently preferred embodiment of the present invention has been described in detail, as will be apparent with those familiar with the art, various changes and modifications can be made in embodiment without departing from the spirit and scope of the present invention as defined by the following claims.

What is claimed is:

1. A chair-type massaging apparatus comprising:

a chair body including a seat portion having a substantially horizontally extending seating surface and a backrest portion extending substantially vertically from the seat portion;

a base disposed inside the backrest portion;

a first pair of right and left massaging heads disposed inside the backrest portion;

a second pair of right and left massaging heads disposed inside the backrest portion and below the first pair of massaging heads, each of the massaging heads of the first and second pairs being pivotally mounted on the base so as to be individually swingable forwardly and inwardly of the backrest portion;

a first elastically deformable connecting member interconnecting the right and left massaging heads of the first pair, said first elastically deformable connecting member having a middle portion serving as a mounting portion at which said first elastically deformable connecting member is mounted on the base, so as to allow each of said first pair of massaging heads to be swingable;

a second elastically deformable connecting member interconnecting the right and left massaging heads of the second pair, said second elastically deformable connecting member having a middle portion serving as a mounting portion at which said second elastically deformable connecting member is mounted on the base, so as to allow each of said second pair of massaging heads to be swingable;

a drive unit for driving each massaging head of the first and second pairs, said drive unit comprising upper and lower pairs of right and left air cells corresponding to the first and second pairs of massaging heads respectively, each air cell of the upper and lower pairs being expansible when air is supplied thereinto and contractible when air is discharged therefrom and being interposed between the base and a respective massaging head of the first and second pairs so as to cause the respective massaging head to swing by expansion and contraction thereof; and control means for controlling the drive unit so as to cause the first and second pairs of massaging heads to perform alternately a first operation such that the left massaging head of the first pair and the right massaging head of the second pair are operated synchronously and a second operation such that the right massaging head of the first pair and the left massaging head of the second pair are operated synchronously.

2. The chair-type massaging apparatus as set forth in claim 1, wherein each of the massaging heads is formed of an elastic material and has a bulged portion for providing a press against a human body.

3. The chair-type massaging apparatus as set forth in claim 1, wherein the first and second elastically deformable connecting members are configured to produce a biasing force urging respective air cells of the upper and lower pairs of right and left air cells to contract when elastically deformed.

4. The chair-type massaging apparatus as set forth in claims 3, wherein each air cell comprises an expansible and contractible bellows.

5. The chair-type massaging apparatus as set forth in claim 1, wherein each air cell is mounted to the base through an inclined support projecting forwardly and extending laterally outwardly with respect to the backrest portion.

6. The chair-type massaging apparatus as set forth in claim 5, wherein each air cell comprises an expansible and contractible bellows.

7. The chair-type massaging apparatus as set forth in claim 1, further comprising a plurality of air discharge assisting members configured to produce a biasing force, each air discharge assisting member coupled to a corresponding air cell of the upper and lower pairs of right and left air cells, said biasing force urging the corresponding air cell to contract.

8. The chair-type massaging apparatus as set forth in claim 7, wherein each air discharge assisting member of said plurality of air discharge assisting members comprises a spring interconnecting the base and an expansion leading end of the corresponding air cell so as to urge the corresponding air cell to a contracted a state.

9. The chair-type massaging apparatus as set forth in claim 8, wherein each massaging head of the first and second pairs is coupled to the expansion leading end of a respective air cell through a respective spring.

10. The chair-type massaging apparatus as set forth in claim 9, wherein each air cell of said upper and lower pairs of right and left air cells comprises an expansible bellows.

11. The chair-type massaging apparatus as set forth in claim 1, wherein the first and second pairs of massaging heads are positioned in a lower portion of the backrest portion so as to massage a waist portion of a user sitting in the chair body.

12. The chair-type massaging apparatus as set forth in claim 11, further comprising a third pair of right and left massaging heads disposed inside the backrest portion and above the first pair of massaging heads, the third pair being substantially vertically movable within the backrest portion.

13. The chair-type massaging apparatus as set forth in claim 12, wherein the first and second pairs of massaging heads are fixed in the lower portion of the backrest portion.

14. The chair-type massaging apparatus as set forth in claim 12, wherein the drive unit comprises three pairs of right and left air cells corresponding to the first, second and third pairs of massaging heads, which air cells are each expansible when air is supplied thereinto and contractible when air is discharged therefrom.

15. The chair-type massaging apparatus as set forth in claim 14, wherein each of the air cells is provided with air discharge assisting means for producing a biasing force urging the air cell to contract.

16. The chair-type massaging apparatus as set forth in claim 14, wherein each of the air cells is of an expansible and contractible bellows construction.

17. The chair-type massaging apparatus as set forth in claim 1, wherein the chair body is reclinable and collapsible.

18. A chair-type massaging apparatus comprising:

a chair body including a seat portion having a seating surface and a backrest portion extending from the seat portion;

a first pair of right and left massaging heads disposed inside the backrest portion;

a second pair of right and left massaging heads disposed inside the backrest portion below the first pair of right and left massaging heads;

a drive unit located in the backrest portion and including first and second pairs of right and left air cells configured to expand and to contract and thereby to drive respective of the first and second pairs of right and left massaging heads;

a first air discharge assisting member which supports the first pair of right and left massaging heads and is configured to bias respective air cells to a contracted state;

a second air discharge assisting member which supports the second pair of right and left massaging heads and is configured to bias respective air cells to a contracted state; and a control device configured to control the drive unit so that the first and second pairs of right and left massaging heads alternate between a first operation in which the left massaging head of the first pair and the right massaging head of the second pair operate synchronously and a second operation in which the right massaging head of the first pair and the left massaging head of the second pair operate synchronously.

19. The massaging apparatus of claim 18, wherein each massaging head of the first and second pairs is made of an elastic material and has a bulged portion for providing a press against a human body.

20. The massaging apparatus of claim 18, wherein each pair of the first and second pairs of right and left massaging heads is configured to swing forwardly and inwardly of the backrest portion.

21. The massaging apparatus of claim 20, further comprising:

a base disposed inside the backrest portion on which the first and second pairs of right and left massaging heads are pivotally supported, the first and second pairs of air cells interposed between the base and respective of the first and second pairs of massaging heads so as to cause the right and left massaging heads to swing.

22. The massaging apparatus of claim 21, wherein:

each of the first and second air discharge assisting members comprises an elastically deformable connecting member having a middle portion at which the elastically deformable connecting member is mounted on the base and about which each massaging head of the first and second pairs swings; and the right and left massaging heads of respective of the first and second pairs are interconnected by the elastically deformable connecting member.

23. The massaging apparatus of claim 22, wherein each elastically deform connecting member is configured to urge respective air cells of the first second pairs of right and left air cells to contract when distorted.

24. The massaging apparatus of claim 23, wherein each air cell comprises an expansible bellows.

25. The massaging apparatus of claim 22, further comprising:

a plurality of inclined supports projecting forwardly and extending laterally outwardly with respect to the backrest portion from the base, each inclined support being disposed between the base and a respective air cell of the first and second pairs of air cells and providing an angle for the respective air cell so that the respective air cell expands substantially straight.

26. The massaging apparatus of claim 25, wherein each air cell comprises an expansible bellows.

27. The massaging apparatus of claim 18, wherein the first and second pairs of right and left massaging heads are positioned in a lower portion of the backrest portion so as to massage a waist portion of a user sitting in the chair body.

28. The massaging apparatus of claim 27, further comprising:

a third pair of right and left massaging heads disposed inside the backrest portion and above the first pair of right and left massaging heads, the third pair of right and left massaging heads being movable within the backrest portion.

29. The massaging apparatus of claim 28, wherein the first and second pairs of right and left massaging heads are fixed in the lower portion of the backrest portion.

30. The massaging apparatus of claim 28, further comprising:

a third pair of right and left air cells provided in correspondence with the third pair of right and left massaging heads.

31. The massaging apparatus of claim 30, wherein each air cell is provided with an air discharge assisting member configured to urge the air cell to contract.

32. The massaging apparatus of claim 30, wherein each air cell comprises an expansible bellows.

33. The massaging apparatus of claim 18, wherein the chair body is reclinable and collapsible.

34. A chair-type massaging apparatus, comprising:

a chair body including a seat portion having a seating surface and a backrest portion extending from the seat portion;

a first pair of right and left massaging heads disposed inside the backrest portion;

a second pair of right and left massaging heads disposed inside the backrest portion below the first pair of right and left massaging heads;

a drive unit located in the backrest portion and including first and second pairs of right and left air cells configured to expand and to contract and thereby to drive respective of the first and second pairs of right and left massaging heads;

a plurality of air discharge assisting members, at least one of the plurality of air discharge assisting members being configured to bias at least one air cell to a contracted state, each air discharge assisting member being coupled to at least one air cell of the first and second pairs of right and left air cells and supporting a respective massaging head of the first and second pairs; and a control device configured to control the drive unit so that the first and second pairs of right and left massaging heads alternate between a first operation in which the left massaging head of the first pair and the right massaging head of the second pair operate synchronously and a second operation in which the right massaging head of the first pair and the left massaging head of the second pair operate synchronously.

35. The massaging apparatus of claim 34, further comprising:

a base disposed inside the backrest portion and on which the first and second pairs of air cells are mounted, each air discharge assisting member comprising a spring interconnecting the base and an expansion leading end of each air cell so as to bias respective air cells to a contracted state.

36. The massaging apparatus of claim 35, wherein each massaging head of the first and second pairs is coupled to the expansion leading end of a respective air cell through a respective spring.

37. The massaging apparatus of claim 36, wherein each air cell comprises an expansible bellows.

* * * * *